US009651330B1

(12) United States Patent
LoRocco et al.

(10) Patent No.: US 9,651,330 B1
(45) Date of Patent: May 16, 2017

(54) DETACHABLE QUIVER ASSEMBLY FOR ARCHERY BOWS

(71) Applicant: TruGlo, Inc., Richardson, TX (US)

(72) Inventors: Paul LoRocco, Dallas, TX (US); John Estridge, Plano, TX (US)

(73) Assignee: TruGlo, Inc., Richardson, TX (US)

( * ) Notice: Subject to any disclaimer, the term of this patent is extended or adjusted under 35 U.S.C. 154(b) by 186 days.

(21) Appl. No.: 14/212,419

(22) Filed: Mar. 14, 2014

Related U.S. Application Data

(60) Provisional application No. 61/788,017, filed on Mar. 15, 2013.

(51) Int. Cl.
*F41B 5/06* (2006.01)

(52) U.S. Cl.
CPC ..... *F41B 5/066* (2013.01)

(58) Field of Classification Search
CPC .. F41B 5/10; F41B 5/14; F41B 5/1403; F41B 5/1426; F41B 5/105; F41B 5/148; F41B 5/123; F41B 5/066; F41B 5/0026; F41B 5/12; F41B 5/0031; F41B 5/06; F41B 5/22
USPC ..... 124/25.7, 44.5, 86, 88
See application file for complete search history.

(56) References Cited

U.S. PATENT DOCUMENTS 4,635,611 A * 1/1987 Priebe ..... F41B 5/066 124/25.7
6,006,734 A * 12/1999 Sodaro ..... F41B 5/066 124/25.5
7,987,842 B2 * 8/2011 McPherson ..... F41B 5/066 124/86
2002/0062826 A1 * 5/2002 Proctor ..... F41B 5/066 124/86
2007/0079820 A1 * 4/2007 Cooper ..... F41B 5/14 124/44.5
2010/0275896 A1 * 11/2010 Ellig ..... F41B 5/066 124/88
2012/0125306 A1 * 5/2012 Kempf ..... F41B 5/066 124/88
2013/0081604 A1 * 4/2013 Lee ..... F41B 5/066 124/88
2013/0167822 A1 * 7/2013 Walk ..... F41B 5/066 124/86

* cited by examiner

*Primary Examiner* — Melba Bumgarner
*Assistant Examiner* — Christopher Glenn
(74) *Attorney, Agent, or Firm* — Alvin R. Wirthlin

(57) ABSTRACT

A quiver assembly for detachable connection to an archery bow includes first and second releasable locking members connectable to an archery bow and a quiver. The first locking member has an elongate base with a dovetail-shaped projection. The second locking member has a dovetail-shaped groove for receiving the projection of the first locking member. Concave depressions are formed on each side of the projection. A locking lever is pivotally connected to the second locking member and includes a lever portion for manipulation by a user and a cam portion with a cam surface that engages one of the depressions when the first and second releasable locking members are connected together. The quiver assembly also includes a hood with an insert having a brightly colored surface to thereby illuminate the hollow interior under ambient light conditions without the need for artificial light.

15 Claims, 6 Drawing Sheets
(1 of 6 Drawing Sheet(s) Filed in Color)

DETACHABLE QUIVER ASSEMBLY FOR ARCHERY BOWS

CROSS-REFERENCE TO RELATED APPLICATIONS

This application claims the benefit of Provisional Application No. 61/788,017 filed on Mar. 15, 2013, the disclosure of which is hereby incorporated by reference.

BACKGROUND OF THE INVENTION

This invention relates to quivers for archery bows, and more particularly to a quiver assembly that is removably connectable to an archery bow.

During hunting or target shooting with an archery bow, it is convenient to have a quantity of arrows readily available to the archer for fast reload. Thus, open rack quivers have been used which are attached to the bow on the side opposite the sight window. During hunting, target practice, transportation and/or storage of the archery bow and its accessories, it is sometimes desirable to quickly remove and attach the quiver for various reasons. Many of these quivers are attached in such a way that it is necessary to unscrew or unbolt the mount to remove the quiver. This can be a difficult and time consuming process, especially when hand tools are required.

Other prior art quick release mechanisms for detachably mounting a quiver to a bow do not require hand tools but suffer other drawbacks. For example, the quiver may become unintentionally separated from the bow when dropped or encountering a foreign object, such as a bush, tree, branch, other equipment carried by the hunter, and so on. In addition, vibration or rattling is prevalent in such mechanisms during hiking or when using the bow. The generation of vibrations during arrow release may lead to inaccurate shooting and additionally may cause noise while being carried by an archer, potentially frightening away game animals.

Moreover, the hood of typical quivers, which captures and shields the hunting tips of arrows from the archer, have a dark interior. Such an interior absorbs ambient light and makes it difficult for the archer to see the arrow tips. Consequently, the shafts and tips of neighboring arrows, as well as the hood, can become scratched, chipped or otherwise damaged when inserting a hunting arrow tip into the hood.

It would therefore be desirous to provide a device that overcomes at least some of the drawbacks of the prior art.

SUMMARY OF THE INVENTION

According to one aspect of the invention, a quick release connector assembly for connecting a first object to a second object includes a first releasable locking member adapted for connection to the first object. The first locking member has an elongate base with one of a dovetail-shaped groove and dovetail-shaped projection. A second releasable locking member for connection to the first releasable locking member has the other of the dovetail-shaped groove and projection. The dovetail-shaped projection includes at least one depression. A locking lever is pivotally connected to the second releasable locking member. The locking lever includes a lever portion for manipulation by a user and a cam portion with a cam surface that engages the at least one depression when the first and second releasable locking members are connected together.

According to another aspect of the invention, a hood assembly for a quiver includes an outer housing having a continuous side wall and upper wall to form a hollow interior, and an inner component constructed of a resilient material. The inner component has at least one of a light color and reflective surface to thereby illuminate the hollow interior under ambient light conditions so that the tips of the arrows located within the hood can be seen by an archer without the need of artificial lighting.

According to yet another aspect of the invention, a quiver assembly includes an elongate rail; a hood assembly connected to an upper portion of the elongate rail; a lower shaft holder connected to the elongate rail; a first releasable locking member adapted for connection to an archery bow and including an elongate base having one of a dovetail-shaped groove and projection; a second releasable locking member extending from the elongate rail and being connectable to the first releasable locking member, and including the other of the dovetail-shaped groove and projection; the dovetail-shaped projection including at least one depression; and a locking lever pivotally connected to the second releasable locking member. The locking lever includes a lever portion for manipulation by a user and a cam portion with a cam surface that engages the at least one depression when the first and second releasable locking members are connected together.

According to another aspect of the invention, a quiver assembly includes an elongate rail; a hood assembly connected to an upper portion of the elongate rail; and a lower shaft holder connected to the elongate rail. The lower shaft holder has a plurality of resilient arrow shaft grippers separated by a slot so that an arrow shaft can be captured within the slot, and at least one finger engagement tab adjacent to the slot for manipulation by a user to facilitate separation of adjacent grippers when inserting or removing arrows with respect to the quiver assembly.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
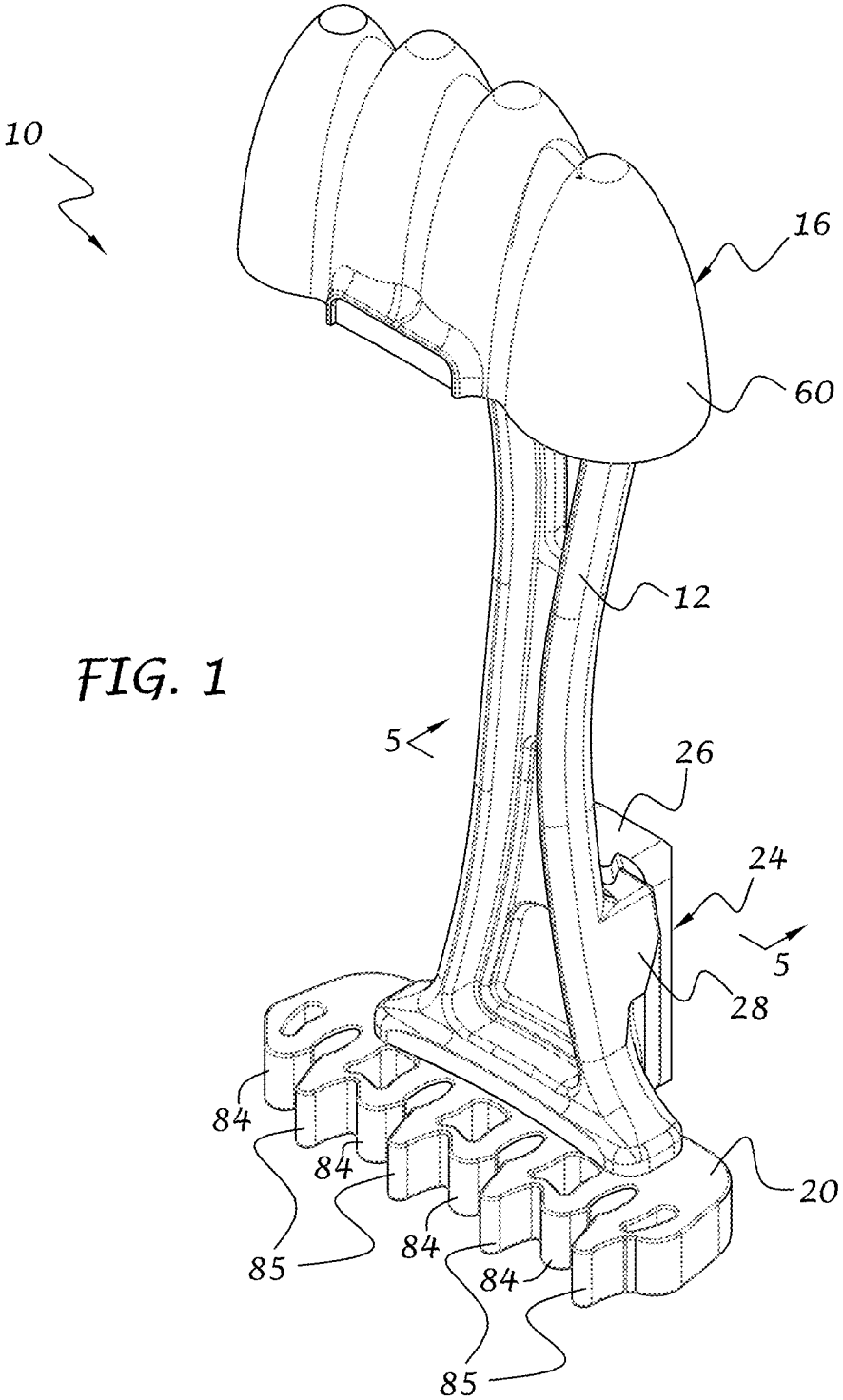
FIG. 1 is a front left-side isometric view of a detachable quiver assembly for archery bows in accordance with the present invention.

Referring now to the drawings, and to FIG. 1 in particular, a detachable quiver assembly 10 in accordance with the present invention is shown. The quiver assembly 10 of the present invention can be adapted for use with any type of bow including, but not limited to, recurve bows, reflex bows, longbows, compound bows, crossbows, and so on. It is also contemplated that the releasable locking members of the present invention can be used in other quick connect/disconnect applications.

Figure 2:
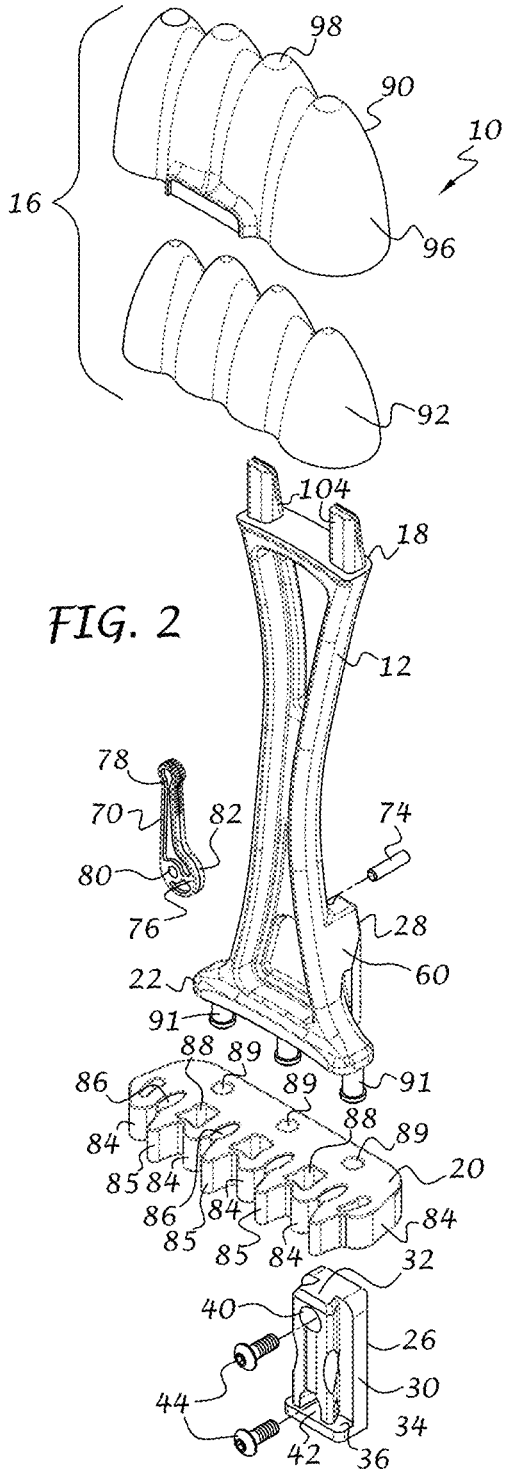
FIG. 2 is a front left-side isometric exploded view thereof.
Figure 3:
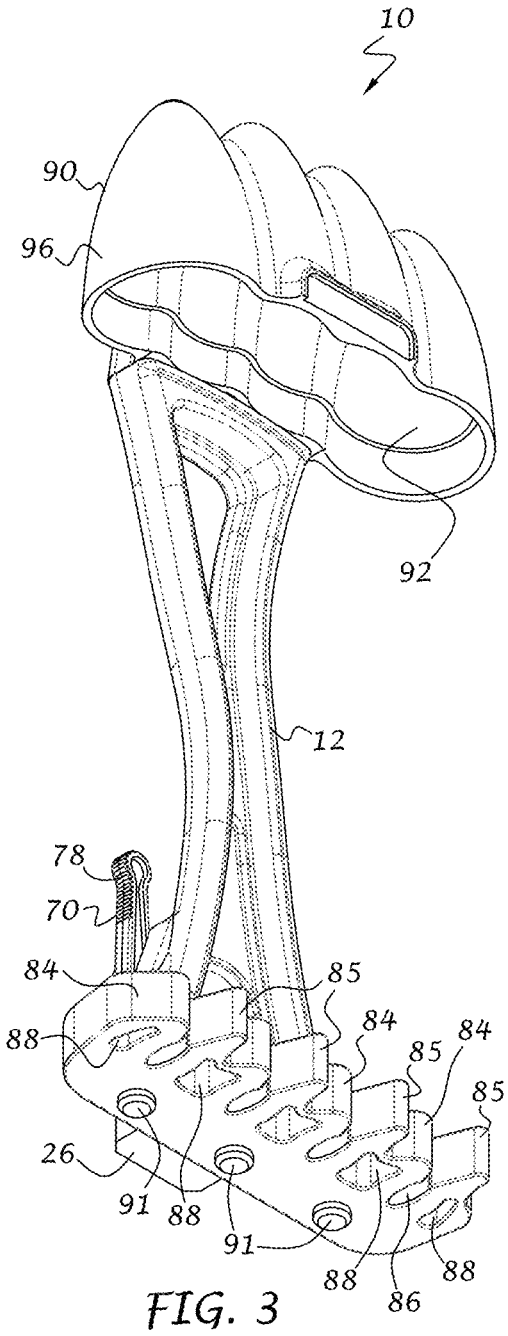
FIG. 3 is a front right-side isometric bottom view thereof.
Figure 4:
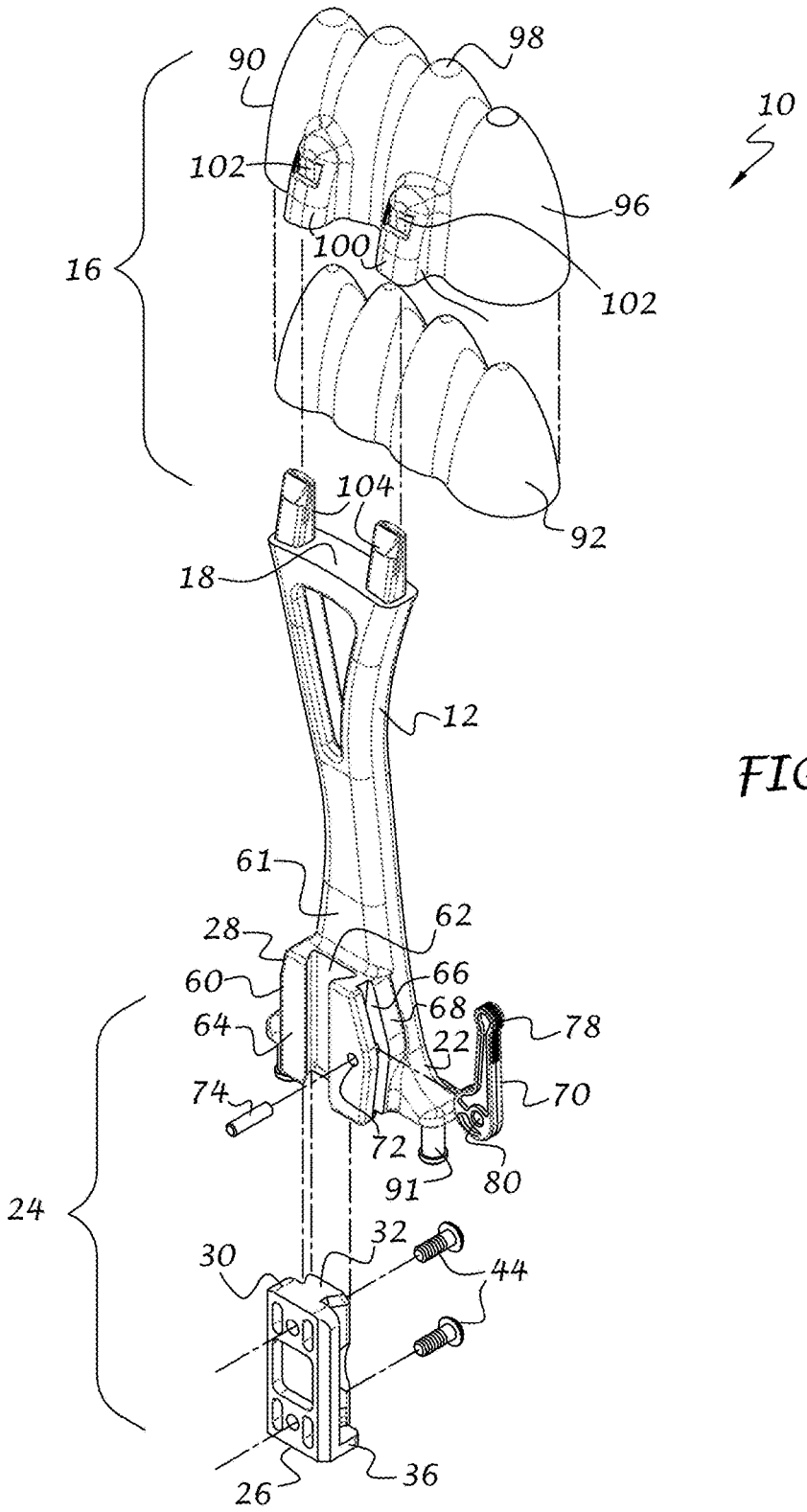
FIG. 4 is a rear right-side isometric exploded view thereof.

With additional reference to FIGS. 2-4, the quiver assembly 10 of the present invention preferably includes an elongate rail 12, a hood assembly 16 connected to an upper mounting section 18 of the rail 12, a lower shaft holder 20 connected to a lower mounting section 22 of the rail 12, and a locking assembly 24 (FIG. 4) including a first releasable locking member 26 for connection to a bow (not shown) and a second releasable locking member 28 connected to the rail 12.

The first releasable locking member 26 can be secured to a bowsight mounting bracket (not shown), which is in turn secured to the riser of a bow (not shown), or alternatively, can be directly connected to the riser or other part of the bow. It will be understood that the first and second releasable locking members can be interchanged so that the first locking member is connected to the quiver and the second locking member is connected to a bow. It will be further understood that the first and second releasable locking members can be connected to other objects either directly or indirectly through one or more intermediate members.

With particular reference to FIGS. 7A-7F, the first releasable locking member 26 preferably includes an elongate base 30 and a dovetail-shaped projection 32 that extends along the length of the base portion from a front face 34 thereof. A shelf 36 also extends from the front face 34 of the base portion 36 and is spaced from the projection 32 to form a gap 38 (FIGS. 7D-7F) therebetween. A first opening 40 and a second opening 42 extend through the base 30 and projection 32 and are sized to receive threaded fasteners 44 (FIGS. 2 and 4) for connecting the first releasable locking member 26 to the riser (not shown) of a bow, bracket, or the like. A first leg 46 and a second leg 48 are formed in the lower portion 50 of the projection 32 on either side of the second opening 42. The legs 46, 48 are capable of flexing toward each other when the locking members 26, 28 are connected together due to the presence of the gap 38. Each leg 46 and 48 preferably includes a bump 52 and 54, respectively, that deflects or crushes during connection of the first and second releasable locking members, as will be described in greater detail below. A first concave depression 56 and a second concave depression 58 are preferably formed on opposite sides of the dovetail-shaped projection 32 for securing the first and second locking members, as will be described in greater detail below.

As best shown in FIG. 4, the second releasable locking member 28 preferably includes a body portion 60 that extends rearwardly from a rear surface 61 of the rail 12. Preferably, the locking member 28 is integrally formed with the rail 12. However, it will be understood that the locking member 28 can be formed separately and connected to the rail through well-known connection means. A dovetail-shaped groove 62 is formed in the body portion 60 and extends forwardly from a rear face 64 thereof. The groove 62 is complementary in size and shape to the dovetail-shaped projection 32 of the first locking member 26 so that the projection 32 can be received in the groove 62 during mutual connection of the first and second locking members. A side slot 66 is formed in a side 68 of the body portion 60 for receiving a locking lever 70. A transverse aperture 72 extends into the body portion 60 and intersects with the side slot 66 for receiving a pivot pin 74, that is preferably fixed with respect to the body portion 60.

Figure 5:
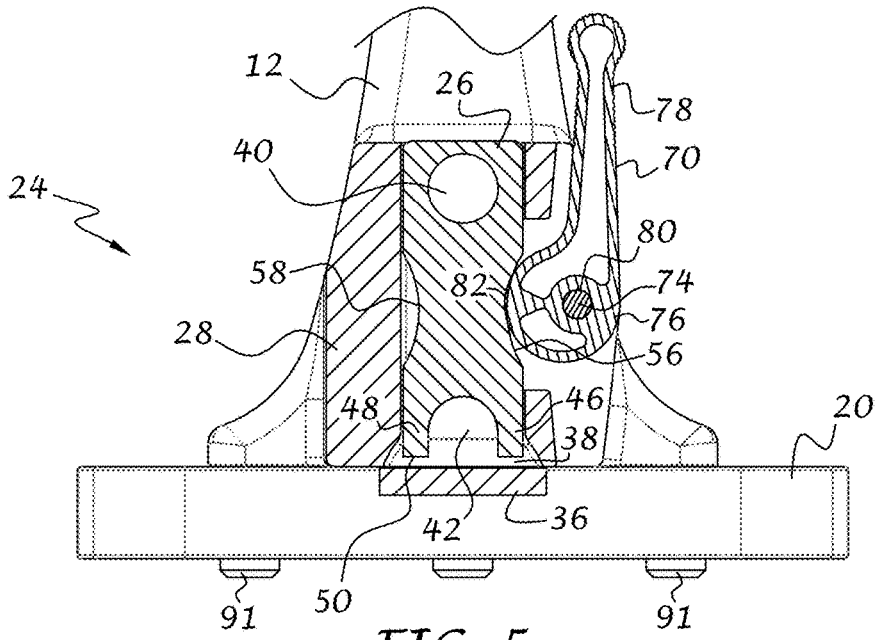
FIG. 5 is a sectional view thereof taken along line 5-5 of FIG. 1 showing the quiver assembly in a locked position.
Figure 6:
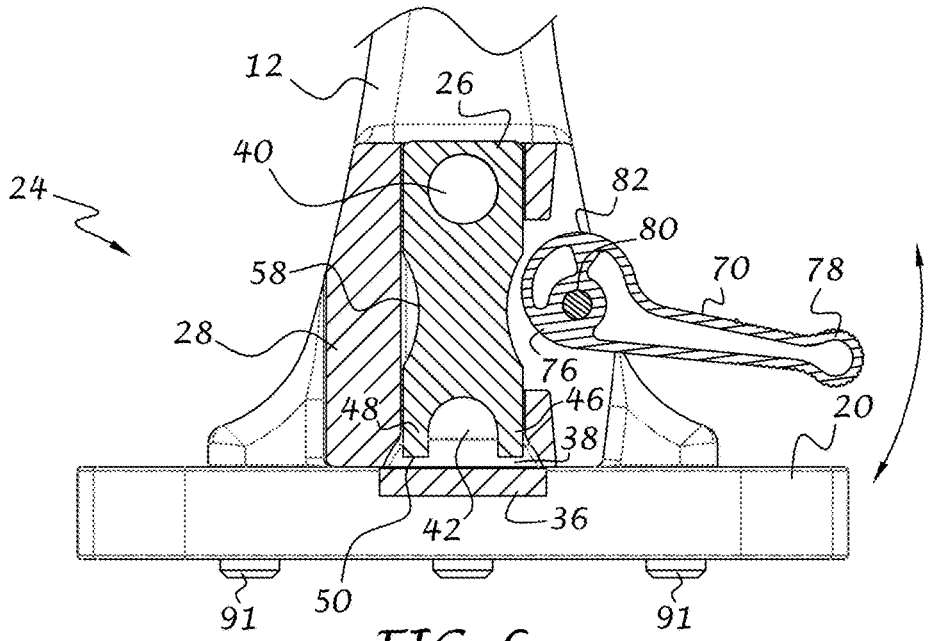
FIG. 6 is a view similar to FIG. 5 showing the quiver assembly in an unlocked position.
Figure 7A:
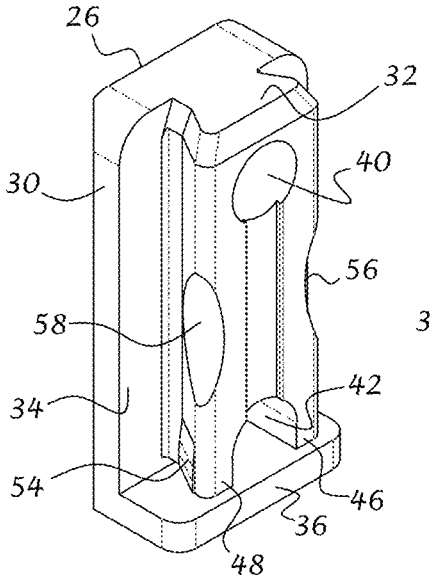
FIG. 7A is a right front isometric view of a locking member in accordance with the invention.
Figure 7C:
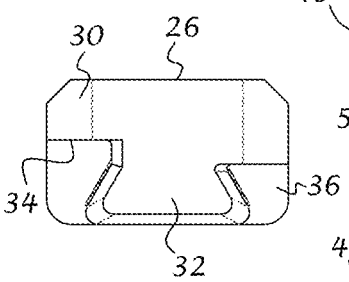
FIG. 7C is a top plan view thereof.
Figure 7B:
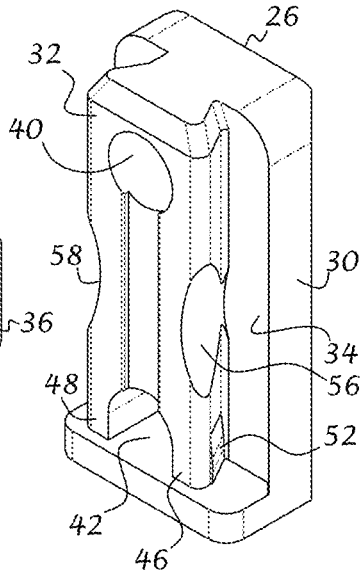
FIG. 7B is a left front isometric view thereof.
Figure 7D:
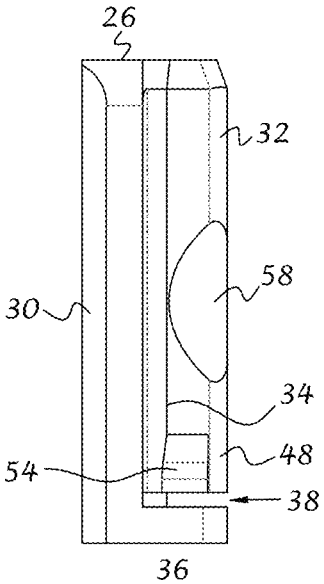
FIG. 7D is a right side elevational view thereof.
Figure 7E:
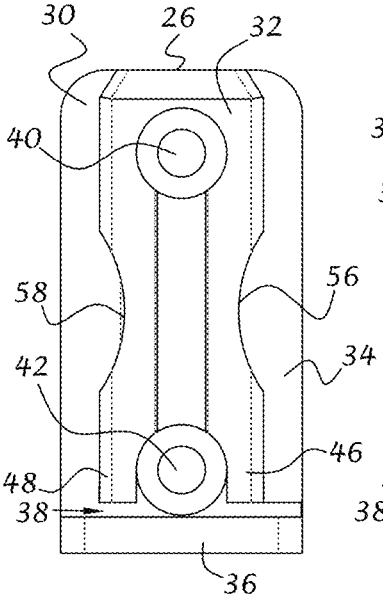
FIG. 7E is a front elevational view thereof.
Figure 7F:
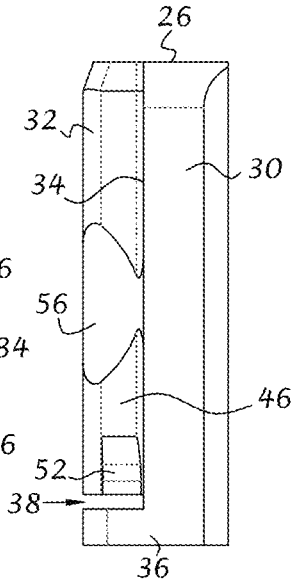
FIG. 7F is a left side elevational view thereof.
Figure 8A:
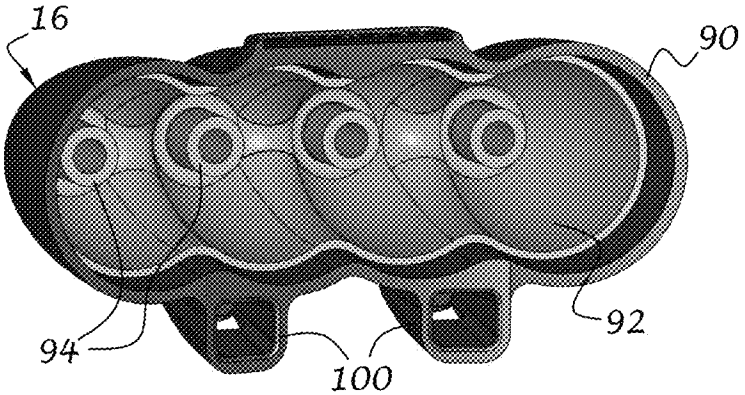
FIGS. 8A-8D are bottom plan views of hood assemblies in accordance with further embodiments of the invention.
Figure 8B:
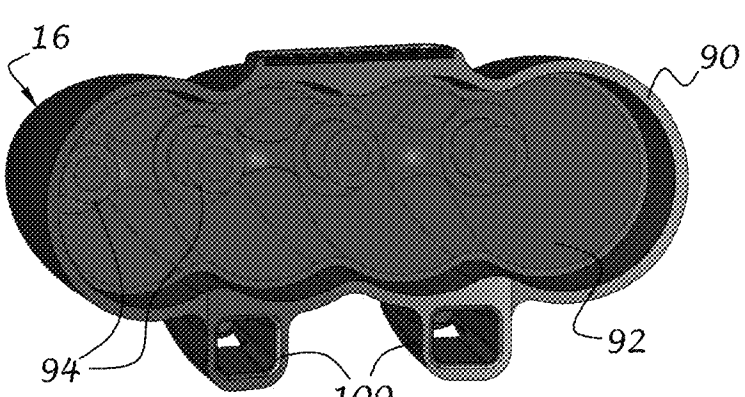
Figure 8C:
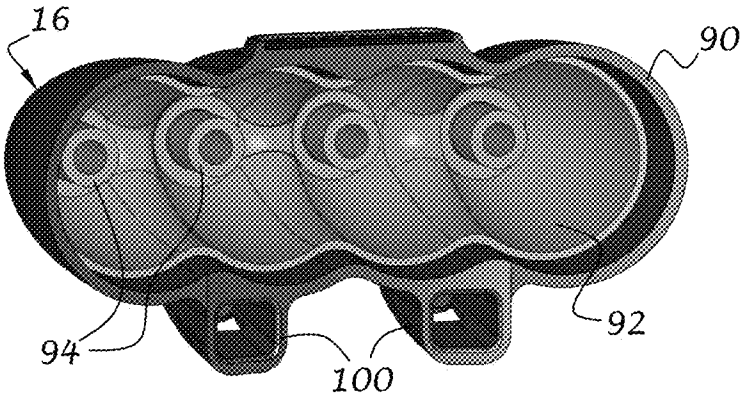
Figure 8D:
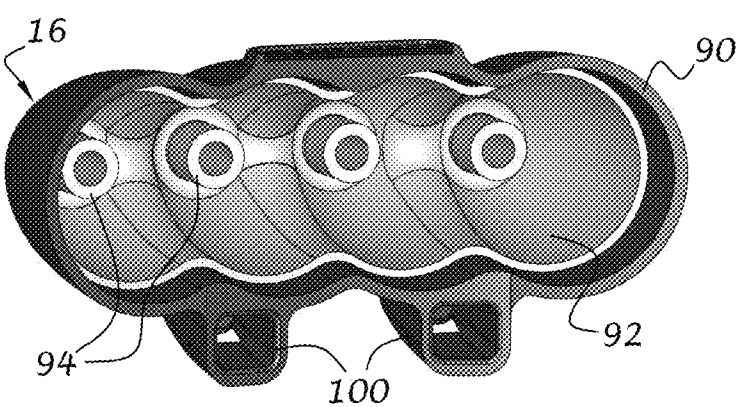

With additional reference to FIGS. 5 and 6, the locking lever 70 preferably includes a cam portion 76 and a lever arm portion 78 that extends from the cam portion. The cam portion 76 is generally circular and includes an offset aperture 80 for receiving the pivot pin 74 to thereby permit pivoting action of the locking lever 70 with respect to the body portion 60 A cam surface 82 is formed on the cam portion 76 for engaging one of the concave depressions 56, 58 of the first locking member 26.

In use, the first locking member 26 is first installed on an archery bow or other structure as previously described. The dovetail-shaped groove 62 of the second locking member is then aligned with the dovetail-shaped projection 32 of the first locking member and the two locking members are slid together, as shown in FIG. 6. The lever arm is then rotated in a counter-clockwise direction, as viewed in FIG. 6 so that the cam surface 82 engages one of the concave depressions 56, 58 of the first locking member. During rotation, the cam surface 82 presses against the concave depression and causes slight flexure of the dovetail-shaped projection 32, due to the gap 38, to thereby positively secure the first and second locking members together and prevent the quiver assembly from vibrating during use of the archery bow or other structure. In order to release the locking members, the lever arm is rotated in the reverse direction and the locking members are slid apart. In this manner, the quiver can be securely and quickly mount to, and quickly removed from, an archery bow or other structure, without the use of hand tools.

Referring to FIGS. 2 and 3, the lower shaft holder 20 preferably includes a generally rectangular-shaped body constructed of an elastomeric or other resilient material. Grippers 84 are formed in the body with a slot 86 extending between each gripper. The slots 86 are adapted for receiving the shaft of an arrow (not shown) and frictionally holding the arrow on the quiver when not in use. An opening 88 is formed in each gripper 84 so that the material surrounding each slot 86 can flex when the shaft of an arrow is inserted therein. Finger engagement tabs 85 are formed at the end of each gripper 84 for manipulation by the thumb or finger of a user to thereby facilitate separation of the grippers and increase the size of the slot 86 during insertion and removal of an arrow shaft while reducing or eliminating noise associated with arrow insertion or removal. This is especially important during hunting where even low volume noise may startle game animals. Apertures 89 are formed in the lower shaft holder 20 for receiving flanged mounting pins 91 that form part of the lower mounting section 22 of the rail 12. The apertures 89 and mounting pins 91 allow the lower shaft holder 20 to be removed and reversed as needed for right-handed and left-handed users. It will be understood that the lower shaft holder is not limited to the particular shape and material described, but may be constructed of any suitable material and shape, and may be connected to the rail in any suitable manner. Moreover, although four slots 86 are shown for holding four arrow shafts, it will be understood that more or less grippers, associated slots and engagement tabs can be provided.

As best shown in FIGS. 4 and 8A-8D, the hood assembly 16 preferably includes an outer housing 90 and an inner component 92 that is shaped to conform to the inner surface of the outer housing 90. The inner component 92 preferably includes hollow protrusions 94 (FIGS. 8A-8D) or the like that are in alignment with the slots 86 of the lower shaft holder 20 to receive arrow tips or points (not shown) and to isolate them from each other and the user. Although four hollow protrusions 94 are shown for holding four arrow tips, it will be understood that more or less protrusions or other tip holding structure can be provided.

The inner component 92 is preferably constructed of a resilient elastomeric material that has a light reflective color or surface. As shown in FIGS. 8A-8D, the inner component 92 can be molded of a material having a distinctive color, such as orange, red, green, and light gray color, respectively, or other light reflecting colors or surfaces. Reflective surfaces can include plating the inner surface of the component 92, such as with chrome or other reflective materials, painting the inner surface, vacuum deposition, or other well-known surface coating means. The distinctive colored material allows ambient light to be reflected rather than absorbed (as in prior art black-colored inserts) so that the archer can see the arrow tips. In this manner, damage to the shafts and tips of neighboring arrows, as well as the hood, can be avoided since the archer is given a clearer view of the hood contents than prior art arrangements without the necessity of artificial light which can add substantial cost to the hood.

It will be understood that the component 92 can be constructed of any suitable material and color or reflective surface as long as ambient light is reflected off of the insert to thereby view arrow tips within the hood assembly 16. Moreover, it will be understood that the inner component 92 can have any desired shape for receiving the tip of one or more arrows. It will also be understood that the inner component 92 can be in the form of a thin surface coating applied directly to the inner surface of the hood 90. It will be further understood that the inner component 92 can be constructed of a relatively hard material or coating rather than a resilient material or coating without departing from the spirit and scope of the invention.

Although not shown, the inner component 92 can wrap around the lower edge of the housing 90 to both protect the edge and prevent noise that may startle game animals when accidently bumped against other objects.

The outer housing 90 preferably has a continuous side wall 96 and an upper wall 98 that form a hollow interior for receiving the component 92. Receptacles or pockets 100 (FIG. 4) extend rearwardly from the side wall 96 and include windows 102 for receiving latch members 104 of the upper mounting section 18 of the rail 12 in a snap-fit engagement. It will be understood that the outer housing 90, and thus the conformal inner component 92, can be of any suitable shape and size and constructed of any suitable material without departing from the spirit and scope of the invention.

It will be understood that the term "preferably" as used throughout the specification refers to one or more exemplary embodiments of the invention and therefore is not to be interpreted in any limiting sense. It will be further understood that the term "connect" and its derivatives refers to two or more parts capable of being attached together either directly or indirectly through one or more intermediate members. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

We claim:

1. A quick release connector assembly for connecting an accessory or accessory mount to the riser of a bow, the assembly comprising:

a first releasable locking member having an elongate base adapted for connection to the riser of the bow and including one of a dovetail-shaped groove and projection extending from the elongate base;

a second releasable locking member for connection to the first releasable locking member and having the other of the dovetail-shaped groove and projection;

the dovetail-shaped projection including opposite sides that converge toward the base at least when the first and second releasable locking members are connected together, with at least one depression formed on at least one of the opposite sides of the dovetail-shaped projection; and a locking lever pivotally connected to the second releasable locking member such that the locking lever pivots in a plane at least substantially parallel to the elongate base, the locking lever including a lever portion for manipulation by a user and a cam portion with a cam surface that engages the at least one depression when the first and second releasable locking members are connected together.

2. A quick release connector assembly according to claim 1, wherein the first releasable locking member comprises at least one deformable bump formed on the one of a dovetail-shaped groove and projection for engaging the other of the dovetail-shaped groove and projection.

3. A quick release connector assembly according to claim 2, and further comprising a shelf extending from the releasable locking member having the dovetail-shaped projection and a gap separating the shelf from the dovetail-shaped projection, wherein the dovetail-shaped projection deforms into the gap when the releasable locking member with the dovetail-shaped groove is installed on the dovetail-shaped projection.

4. A quick release connector assembly according to claim 3, wherein the dovetail-shaped projection comprises an opening that forms a first leg and a second leg, wherein the first and second legs deform into the gap during connection of the first and second locking members.

5. A quick release connector assembly according to claim 4, wherein each leg comprises the deformable bump such that the first and second legs deform toward each other into the opening during connecting of the first and second locking members.

6. A quick release connector assembly according to claim 5, wherein the opening is sized for receiving a fastener for securing one of the first and second releasable locking members to the riser of a bow.

7. A quiver assembly comprising:

an elongate rail;

a hood assembly connected to an upper portion of the elongate rail;

a lower shaft holder connected to the elongate rail;

a first releasable locking member having an elongate base adapted for connection to an archery bow, the elongate base having one of a dovetail-shaped groove and projection;

a second releasable locking member extending from the elongate rail and being connectable to the first releasable locking member, and including the other of the dovetail-shaped groove and projection;

the dovetail-shaped projection including opposite sides that are angled with respect to the elongate base, with at least one depression formed on at least one of the opposite sides of the dovetail-shaped projection; and a locking lever pivotally connected to the second releasable locking member such that the locking lever pivots in a plane at least substantially parallel to the elongate base, the locking lever including a lever portion for manipulation by a user and a cam portion with a cam surface that engages the at least one depression when the first and second releasable locking members are connected together.

8. A quiver assembly according to claim 7, wherein the hood assembly comprises:

an outer housing having a continuous side wall and upper wall to form a hollow interior; and an inner component having at least one of a bright distinctive color and a reflective surface to thereby illuminate the hollow interior under ambient light conditions and thus expose at least a portion of an arrow tip when located therein without the need for artificial light.

9. A quiver assembly according to claim 8, wherein the inner component comprises a shape that conforms to the hollow interior of the outer housing.

10. A quiver assembly according to claim 7, wherein the lower shaft holder comprises a plurality of resilient arrow shaft grippers separated by a slot so that an arrow shaft can be captured within the slot, and at least one finger engagement tab for manipulation by a user to facilitate separation of adjacent grippers.

11. A quick release connector assembly according to claim 7, wherein the first releasable locking member comprises the dovetail-shaped projection with at least one deformable bump formed on the dovetail-shaped projection for engaging the dovetail-shaped groove.

12. A quick release connector assembly according to claim 11, and further comprising a shelf extending from the first releasable locking member below the dovetail-shaped projection, with a gap separating the shelf from the dovetail-shaped projection, wherein the dovetail-shaped projection deforms into the gap when the second releasable locking member with the dovetail-shaped groove is installed on the dovetail-shaped projection.

13. A quick release connector assembly according to claim 12, wherein the dovetail-shaped projection comprises an opening that forms a first let and a second leg, wherein the first and second legs deform into the gap during connection of the first and second locking members.

14. A quick release connector assembly according to claim 13, wherein each leg comprises the deformable bump such that the first and second legs deform toward each other into the opening during connecting of the first and second locking members.

15. A quick release connector assembly according to claim 14, wherein the opening is sized for receiving a fastener for securing the first releasable locking member to the riser of a bow.

* * * * *